US006743360B2

(12) United States Patent
Petersen et al.

(10) Patent No.: US 6,743,360 B2
(45) Date of Patent: Jun. 1, 2004

(54) MANHOLE DEBRIS-CATCHING SYSTEM

(76) Inventors: John G. Petersen, 9034 N. 23rd Ave., Suite 10, Phoenix, AZ (US) 85021-2850; William C. Holmes, 9034 N. 23rd Ave., Suite 10, Phoenix, AZ (US) 85021-2850

( * ) Notice: Subject to any disclaimer, the term of this patent is extended or adjusted under 35 U.S.C. 154(b) by 0 days.

(21) Appl. No.: 10/614,874

(22) Filed: Jul. 7, 2003

(65) Prior Publication Data

US 2004/0007512 A1 Jan. 15, 2004

Related U.S. Application Data

(63) Continuation-in-part of application No. 09/921,768, filed on Aug. 3, 2001, now Pat. No. 6,613,228.
(60) Provisional application No. 60/228,355, filed on Aug. 28, 2000.

(51) Int. Cl.[7] ..... E02D 29/12; E02D 29/14

(52) U.S. Cl. ..... 210/541; 52/20; 52/21; 52/124.2; 405/36

(58) Field of Search ..... 210/541; 52/20, 52/21, 124.2; 405/36

(56) References Cited

U.S. PATENT DOCUMENTS

| | | | | | |
|---|---|---|---|---|---|
| 3,621,623 | A | * | 11/1971 | Downes | 404/25 |
| 4,030,851 | A | * | 6/1977 | Graybeal | 404/25 |
| 4,305,851 | A | * | 12/1981 | Tominaga et al. | 525/195 |
| 4,957,389 | A | * | 9/1990 | Neathery | 404/72 |
| 5,382,113 | A | * | 1/1995 | Chilton et al. | 404/25 |
| 5,540,411 | A | * | 7/1996 | Strickland | 249/145 |
| 5,752,787 | A | * | 5/1998 | Trangsrud | 405/154.1 |
| 6,226,928 | B1 | * | 5/2001 | Trangsrud | 52/20 |

* cited by examiner

*Primary Examiner*—Thomas M. Lithgow
(74) *Attorney, Agent, or Firm*—Martin L. Stoneman

(57) ABSTRACT

A debris-catching system for preventing debris from falling into the pipe opening at the bottom of a manhole catch basin. The debris-catcher comprises two semi-circular halves hinged together such that the two halves may be folded and inserted into a manhole opening. The debris-catcher comprises aligned apertures that allow it to be hooked and lowered into a manhole. The two halves are opened up to form a circular blocker which sets on the manhole bottom flat base. The debris-catcher allows normal effluent flow through the manhole while in place. The debris-catcher floats and will do so during an overflow condition. Further, the debris-catcher will resume its protective function after an overflow condition has subsided.

17 Claims, 6 Drawing Sheets

MANHOLE DEBRIS-CATCHING SYSTEM

CROSS-REFERENCE TO RELATED APPLICATION

The present application is a continuation-in-part of related application Ser. No. 09/921,768, filed Aug. 3, 2001 now U.S. Pat. No. 6,613,228, entitled "MANHOLE DEBRIS-CATCHING SYSTEM", which is related to prior provisional application Serial No. 60/228,355, filed Aug. 28, 2000, entitled "DYNAMIC DEBRIS SHIELD", the contents of both of which are incorporated herein by this reference and are not admitted to be prior art with respect to the present invention by the mention in this cross-reference section.

BACKGROUND

This invention relates to providing a debris-catching system for preventing debris from falling or being thrown, etc., into the pipe opening (sometimes herein called "pipe trench") at the bottom of a manhole catch basin.

Typically, manholes are placed for the purpose of servicing storm or sewer systems. Such manholes typically consist of a bottom catch basin constructed of brick, pre-cast concrete or poured-on-site concrete set at the level of the fluid transferring pipe. One end of at least one pipe typically is set into the manhole such that the effluent flows into one or more trenches in the manhole bottom and flows through the manhole into one or more pipes entering other portions of the manhole. Such other pipes are generally within the same vertical elevation, but sometimes may be at slightly varied elevations. Such pipe may be only a few feet below ground, to many feet below ground, in a general range of about four to twenty feet. Catch basins are usually provided in pre-selected diameters. Typically, pre-cast sections of the manhole may be added to the lower portion to adjust the manhole in height to account for the depth required to reach the surface height. The manhole typically comprises a ladder (made up of ladder rungs spaced apart) within it in which a person may use to descend to the manhole bottom. The manhole is typically removably sealed by a cover, which is usually flush with the surface. The surface usually consists of landscape, an alleyway, parking area or roadway, as the storm and sewer lines are generally placed within an easement in such an area.

In new construction, the manhole is placed and the piping is attached to the manhole. However, because the surface is usually the last area to be finished, the manhole is only temporarily covered. Such covers are usually made of metal and cover only the top of the manhole. Debris often enters the manhole as vehicles and other construction activity occurs. Such debris may easily amount to hundreds of pounds of dirt, asphalt or rain-washed debris from the construction site. The piping may or may not be in use during this construction activity. If the piping is new and not in use, it is usually inspected prior to being buried. After such inspection, it is a costly endeavor to expose the pipe, or have it vacuumed out if it becomes blocked due to debris. If the piping is in use, an expensive and messy blockage may occur.

A need exists to adequately protect such piping in a manhole from debris blockage while still permitting the piping to be utilized.

OBJECTS OF THE INVENTION

A primary object and feature of the present invention is to provide a system for blocking debris from entering the piping system of a manhole.

It is a further object and feature of the present invention to provide such a system that assists in preventing debris from entering the piping system within the manhole.

It is a further object and feature of the present invention to provide such a system that is easily installed and removed.

It is a further object and feature of the present invention to provide such a system that provides for the continued system operation in the event the manhole is flooded.

It is a further object and feature of the present invention to provide such a system that provides a lifting and setting device for assisting in the placement and removal of the system from a manhole.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a debris-catching system for impeding debris from entering pipe trench portions of a manhole catch basin, having a round top with a first diameter, flat bottom portions extending over a first area having a second diameter larger than the first diameter, and pipe trench portions below the flat bottom portions, comprising, in combination: substantially-rigid blocker means, supportable by the flat bottom portions and larger than the round top, for blocking debris from entering the pipe trench portions; and fold means for folding such blocker means so as to permit entry of such blocker means, when folded, into the manhole catch basin through the round top.

Additionally, it provides such a system wherein such blocker means comprises attachment means for attaching at least one lifting device to such blocker means. It also provides such a system wherein such attachment means comprises at least one aperture; and it provides such a system wherein such blocker means is floatable. Further, it provides such a system wherein such fold means comprises at least one hinge. And, it provides such a system wherein such blocker means, when not folded and when supported by the flat bottom portions, is capable of substantially covering the pipe trench portions. Moreover, it provides such a system wherein such blocker means, when not folded and when supported by the flat bottom portions, is capable of substantially covering the pipe trench portions. It provides such a system wherein such blocker means, when not folded and when supported by the flat bottom portions, is capable of supporting at least about one-hundred pounds.

In accordance with another preferred embodiment hereof, this invention provides a debris-catching system for impeding debris from entering pipe trench portions of a manhole catch basin, having a round top with a first diameter, flat bottom portions extending over a first area having a second diameter larger than the first diameter, and pipe trench portions below the flat bottom portions, comprising, in combination: substantially-rigid blocker, supportable by the flat bottom portions and larger than the round top, structured and arranged, when not folded and when supported by the flat bottom portions, to block debris from entering the pipe trench portions; and at least one hinge structured and arranged to permit folding of such blocker so as to permit entry of such blocker, when folded, through the round top.

It also provides such a system wherein such blocker is substantially round. And, it provides such a system wherein such blocker comprises at least one hinge connection having at least one hinge axis through a center of such blocker. It even provides such a system wherein such blocker is floatable. Further, it provides such a system wherein such at least one hinge connection comprises three corrosion-resistant strap hinges. And, it provides such a system wherein such at least one hinge connection comprises: three stainless steel strap hinges; and a plurality of stainless steel bolts, corrosion resistant washers, and stainless steel nuts; wherein such plurality of stainless steel bolts, corrosion resistant washers and stainless steel nuts connects such three stainless steel strap hinges with such blocker.

Even further, it provides such a system wherein such blocker comprises at least one attachment structured and arranged to permit removable attaching of at least one lifting device to such blocker. It also provides such a system wherein such attachment comprises at least one aperture. Still further, it provides such a system wherein such blocker, when not folded and when supported by the flat bottom portions, substantially covers the pipe trench portions. And, it provides such a system wherein such blocker is capable of supporting at least one-hundred pounds of debris. Still further, it provides such a system wherein such blocker is capable of supporting at least one normal-sized worker.

In accordance with yet another preferred embodiment hereof, this invention provides a debris-catching system for impeding debris from entering pipe trench portions of a manhole catch basin, having a round top with a first diameter, flat bottom portions extending over a first area having a second diameter larger than the first diameter, and pipe trench portions below the flat bottom portions, comprising, in combination: a substantially round blocker, wherein such blocker comprises, a substantially-rigid structural material, two half-portions, at least one hinge connection connecting such two half-portions; wherein such blocker may be placed in a substantially folded position and in an open substantially-flat position, wherein each such half-portion comprises an aperture, each such aperture being structured and arranged to align with each other such aperture when such blocker is placed in such substantially folded position, whereby such apertures may be used as attachments in lifting and lowering such blocker when such blocker is in such substantially folded position; wherein such substantially round blocker, when in such open substantially-flat position, is structured and arranged to be able to substantially cover the pipe trench portions.

Additionally, it provides such a system wherein such substantially round blocker has a diameter selected from the group consisting of: diameters of about forty-four inches to about forty-eight inches; diameters of about fifty-four inches to about sixty inches. And, it provides such a system wherein such structural material comprises High Density Polyethylene (HDPE). Further, it provides such a system wherein such at least one hinge connection comprises: three corrosion-resistant strap hinges; and a plurality of corrosion-resistant bolts, corrosion-resistant washers, and corrosion-resistant nuts; wherein such plurality of corrosion-resistant bolts, corrosion-resistant washers and corrosion-resistant nuts connects such corrosion-resistant strap hinges to such substantially round blocker. In accordance with a preferred embodiment hereof, this invention also provides a method of making a debris-catcher, for impeding debris from entering pipe trench portions of a manhole catch basin, having a round top with a first diameter, flat bottom portions extending over a first area having a second diameter larger than the first diameter, and pipe trench portions below the flat bottom portions, comprising the steps of: providing a structural material having an area capable of being cut to a diameter of the required end size; cutting such structural material into two equal halves; cutting each such half in a semi-circle shape having a radius half that of such desired end diameter of such debris-catcher so that each such respective half is substantially equal to each other such half; drilling a lifting aperture in each such half wherein: each such lifting aperture is structured and arranged to align with each other respective such lifting aperture when each respective such half is aligned; and whereby each respective aligned lifting aperture can be used together to lift such halves when aligned; drilling a plurality of hinge-installation apertures in each such half in such manner as to enable insertion of a corrosion-resistant bolt through each respective such hinge-installation aperture; attaching at least one hinge to each such half using such corrosion-resistant bolts, at least one washer, and at least one corrosion-resistant nut, along a hinge axis corresponding to a flat edge of each such half so that such halves can be folded together in a folded position for entry through the top and opened to a substantially-flat position to provided a round such debris catcher having such desired diameter of such required end size. It also provides such a system wherein such structural material comprises High Density Polyethylene (HDPE). And, it provides such a system wherein such at least one hinge comprises three corrosion-resistant strap hinges.

In accordance with another preferred embodiment hereof, this invention also provides a method of using a debris-catcher for impeding debris from entering pipe trench portions of a manhole catch basin, having a round top with a first diameter, flat bottom portions extending over a first area having a second diameter larger than the first diameter, and pipe trench portions below the flat bottom portions wherein the debris catcher comprises a substantially round blocker comprising a substantially-rigid structural material, two half-portions, at least one hinge connection having a hinge axis and connecting the two half-portions, and wherein the blocker may be placed in a substantially folded position or in an open substantially-flat position, and wherein each such half-portion comprises an aperture, each such aperture being structured and arranged to align with each other such aperture when such blocker is placed in such substantially folded position, comprising the steps of: selecting a debris-catcher having such desired diameter of such required end size structured and arranged to substantially cover the pipe trench portions below the flat bottom portions when opened to a substantially-flat position; folding the debris-catcher in a folded position along a hinge axis corresponding to a flat edge of each such half so that such halves can be folded together in a folded position for entry through the round top of the manhole; attaching a lifting device through each aligned aperture and lifting and lowering the debris-catcher through the top of the manhole and down through the manhole catch basin to the flat bottom portions; un-attaching the lifting device from the debris-catcher; unfolding the debris-catcher such that the debris-catcher is opened to a substantially-flat position with the hinges facing upward toward the top of the manhole; aligning the hinge axis such that most of the hinge axis is supported by the flat bottom portions.

In accordance with a preferred embodiment hereof, this invention provides a debris-catching system for impeding debris from entering pipe trench portions of a manhole catch basin having a round top with a first diameter, flat bottom portions extending over a first area having a second diameter larger than the first diameter, and pipe trench portions below the flat bottom portions, such system comprising, in combination: substantially-rigid blocker means, supportable by the flat bottom portions and larger than the round top, for blocking debris from entering the pipe trench portions; and fold means for folding such blocker means so as to permit entry of such blocker means, when folded, into the manhole catch basin through the round top; support means for supporting such substantially-rigid blocker means and cooperating with at least one blocker lifting device; and connector means for connecting such substantially-rigid blocker means with such at least one support.

In accordance with another preferred embodiment hereof, this invention provides a debris-catching system for impeding debris from entering pipe trench portions of a manhole catch basin having a round top with a first diameter, flat bottom portions extending over a first area having a second diameter larger than the first diameter, and pipe trench portions below the flat bottom portions, such system comprising, in combination: at least one substantially-rigid blocker, supportable by the flat bottom portions and larger than the round top, structured and arranged, when not folded and when supported by the flat bottom portions, to block debris from entering the pipe trench portions; at least one hinge structured and arranged to permit folding of such at least one substantially-rigid blocker so as to permit entry of such at least one substantially-rigid blocker, when folded, through the round top; at least one support structured and arranged to support such at least one substantially-rigid blocker and cooperate with at least one blocker lifting device; and at least one connector structured and arranged to connect such at least one substantially-rigid blocker with such at least one support. Moreover, it provides such a debris-catching system wherein such at least one substantially-rigid blocker comprises at least one hinge connection having at least one hinge axis through a center of such at least one blocker to permit folding of such at least one substantially-rigid blocker along such at least one hinge axis. Additionally, it provides such a debris-catching system wherein such at least one connector and such at least one support are structured and arranged to open such at least one hinge upon lowering onto the manhole catch basin by the at least one blocker lifting device to properly place such at least one substantially-rigid blocker. Also, it provides such a debris-catching system wherein such at least one connector and such at least one support are structured and arranged to close such at least one hinge upon raising from the manhole catch basin by the at least one blocker lifting device of such at least one substantially-rigid blocker. In addition, it provides such a debris-catching system wherein such at least one connector and such at least one support are structured and arranged to close such at least one hinge upon raising from the manhole catch basin by the at least one blocker lifting device of such at least one substantially-rigid blocker. And, it provides such a debris-catching system wherein such at least one support comprises at least one flexible tensioner perpendicular to, adjacent to, and above such hinge axis. Further, it provides such a debris-catching system wherein such at least one flexible tensioner comprises a steel cable. Even further, it provides such a debris-catching system wherein such at least one flexible tensioner is structured and arranged to support such at least one substantially-rigid blocker while being grabbed by the at least one blocker lifting device. Moreover, it provides such a debris-catching system further comprising at least one blocker lifting device structured and arranged to grab the at least one flexible tensioner. Additionally, it provides such a debris-catching system wherein such at least one lifting device comprises: at least one pole, having at least one hook, structured and arranged to removably grab the at least one flexible tensioner. Also, it provides such a debris-catching system wherein such at least one connector further comprises at least two eye-end bolts having such steel cable attached between each respective of such at least two eye-ends. In addition, it provides such a debris-catching system wherein such at least one hinge connection comprises: three corrosion-resistant strap hinges; and a plurality of corrosion-resistant bolts, corrosion-resistant washers, and corrosion-resistant nuts; and at least one strap connector, placed across such hinge axis, structured and arranged to be grabbed by such at least one hook; wherein such plurality of corrosion-resistant bolts, corrosion-resistant washers and corrosion-resistant nuts connects such corrosion-resistant strap hinges to such substantially-rigid blocker; and wherein such at least one strap connector, when grabbed by such at least one hook, assists a user to place such substantially-rigid blocker in such open substantially-flat position.

In accordance with another preferred embodiment hereof, this invention provides a debris-catching system for impeding debris from entering pipe trench portions of a manhole catch basin having a round top with a first diameter, flat bottom portions extending over a first area having a second diameter larger than the first diameter, and pipe trench portions below the flat bottom portions, such system comprising, in combination: a substantially round blocker, wherein such blocker comprises, at least one substantially-rigid structural material, two half-portions, at least one hinge connection connecting such two half-portions; wherein such substantially round blocker may be placed in a substantially folded position and in an open substantially-flat position, wherein each such half-portion comprises an eye-end, each such eye-end having at least one wire attached between such eye-ends and being structured and arranged to place such blocker in a substantially folded position when such wire is pulled, wherein such wire may be used in lifting and lowering such substantially round blocker when such substantially round blocker is in such substantially folded position; wherein such substantially round blocker, when in such open substantially-flat position, is structured and arranged to be able to substantially cover the pipe trench portions. And, it provides such a debris-catching system wherein such at least one substantially round blocker has a diameter selected from the group consisting of: diameters of about forty-four inches to about forty-eight inches; diameters of about fifty-four inches to about sixty inches. Further, it provides such a debris-catching system wherein such at least one substantially-rigid structural material comprises High Density Polyethylene (HDPE).

In accordance with another preferred embodiment hereof, this invention provides a method of using a debris-catcher for impeding debris from entering pipe trench portions of a manhole catch basin having a round top with a first diameter, flat bottom portions extending over a first area having a second diameter larger than the first diameter, and pipe trench portions below the flat bottom portions wherein the debris catcher comprises a substantially round blocker comprising a substantially-rigid structural material, two half-portions, at least one hinge connection having a hinge axis and connecting the two half-portions, and wherein the blocker may be placed in a substantially folded position or in an open substantially-flat position, and wherein each such half-portion comprises at least one flexible tensioner, perpendicular to such hinge axis, being structured and arranged to support such at least one substantially round blocker while being grabbed by at least one blocker rigid lifting device, comprising the steps of: selecting a debris-catcher having such desired diameter of such required end size structured and arranged to substantially cover such pipe trench portions below such flat bottom portions when opened to a substantially-flat position; grabbing such at least one flexible tensioner with such at least one blocker rigid lifting device and lifting and lowering such folded debris-catcher through such top of such manhole and down through such manhole catch basin to such flat bottom portions; un-attaching such at least one blocker rigid lifting device from such debris-catcher; unfolding such debris-catcher such that such debris-catcher is opened to with such hinges facing upward toward such top of such manhole; aligning such hinge axis so that most of such hinge axis is supported by such flat bottom portions; and placing such rigid lifting device against at least one hinge and pressing such debris catcher into a substantially-flat position.

DETAILED DESCRIPTION OF A PREFERRED EMBODIMENT OF THE INVENTION

Figure 1:
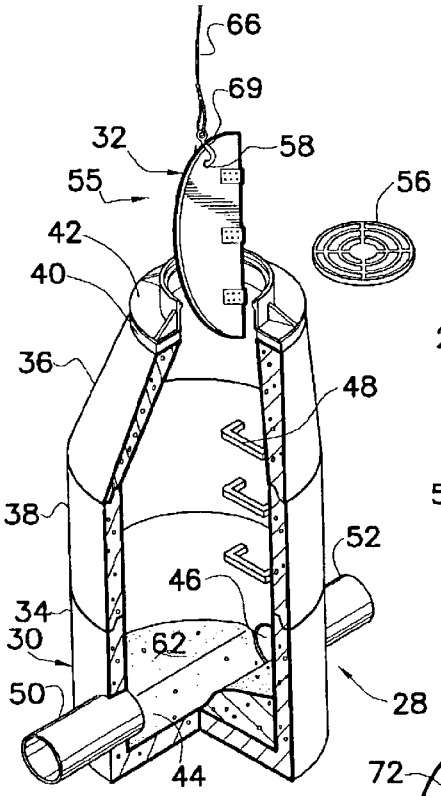
FIG. 1 is a perspective view, partially in section, of a typical manhole structure illustrating the debris-catching system and insertion of a debris-catcher, according to a preferred embodiment of the present invention.

Reference is now made to the drawings. FIG. 1 is a perspective view, partially in section, of a typical manhole structure 30 illustrating the debris-catching system 28 and insertion of a debris-catcher 32 (embodying herein substantially-rigid blocker means, supportable by the flat bottom portions and larger than the round top, for blocking debris from entering the pipe trench portions; and also embodying herein a substantially-rigid blocker, supportable by the flat bottom portions and larger than the round top, structured and arranged, when not folded and when supported by the flat bottom portions, to block debris from entering the pipe trench portions), according to a preferred embodiment of the present invention. A typical manhole structure 30 comprises a lower portion 34, a top portion 36, and may comprise one or more center portions 38. The center portions 38 assist in adjusting the manhole structure 30 to the approximate desired height. In addition, the top portion 36 may also comprise additional height adjusting rings 40 and a manhole cover mounting frame 42 to more closely adjust the height required to reach the surface 31 (shown best on FIG. 6). Preferably, the lower portion 34 comprises one or more depressions identified as trench 44. Preferably, trench 44 is in line with the inflow pipe 50 or outflow pipe 52 (no particular order is intended, as either pipe may be inflow or outflow; such inflow pipe 50 or such outflow pipe 52 may comprise more than one pipe) and allows access to the pipe interior 46 for maintenance purposes. Preferably, the manhole structure 30 also comprises a plurality of ladder rungs 48 for entry into the manhole structure 30. The manhole opening 54 is a standard size, preferably round in shape, as shown. Such manhole openings 54 are typically twenty-four inches in diameter, or thirty inches in diameter. Preferably, a cover 56 of the appropriate size sets in the manhole cover mounting frame 42 and covers the manhole opening 54.

Preferably, debris-catcher 32 comprises two apertures 58 and 60 (embodying herein wherein such blocker means comprises attachment means for attaching at least one lifting device to such blocker means; and embodying herein wherein such attachment means comprises at least one aperture; and also embodying herein wherein such blocker comprises at least one attachment structured and arranged to permit removable attaching of at least one lifting device to such blocker; and further embodying herein wherein such attachment comprises at least one aperture), which align when the debris-catcher 32 is folded, as shown (the above arrangement embodying herein wherein each such half-portion comprises an aperture, each such aperture being structured and arranged to align with each other such aperture when such blocker is placed in such substantially folded position). Preferably, an attacher, such as a hook 64, is attached through the aligned apertures 58 and 60. Preferably, in combination with a lowering mechanism, such as a rope 66 (this arrangement embodying herein at least one lifting device), the debris-catcher 32 may be lowered or raised through the manhole opening 54 (this arrangement embodying herein whereby such apertures may be used as attachments in lifting and lowering such blocker when such blocker is in such substantially folded position), while in a substantially folded position 55, to the flat base 62 portion of the lower portion 34. Upon reading the teachings of this specification, those with ordinary skill in the art, will now appreciate that, under appropriate circumstances, considering issues such as manhole depth, etc., other methods of lowering the debris-catcher 32, such as, for example, using cables, poles, etc., may suffice. The debris-catcher 32 may be carried down the ladder rungs 48; however, due to the weight and size of the debris-catcher 32, such a method may be undesirable and is not preferred.

Figure 2:
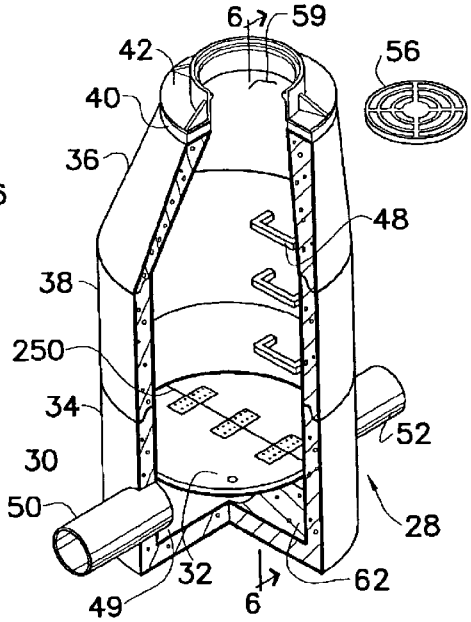
FIG. 2 is a perspective view, partially in section, of a typical manhole structure and an installed debris-catcher, according to a preferred embodiment of the present invention.

FIG. 2 is a perspective view, partially in section, of a typical manhole structure 30 and an installed debris-catcher 32, according to a preferred embodiment of the present invention. Preferably, the debris-catcher 32 is opened up and placed in a substantially open position 68 on the flat base 62 portion of the lower portion 34 of the manhole structure 30, as shown in FIG. 2. Preferably, the debris-catcher 32 rests directly on the flat base 62 and substantially covers trench 44 (the above described arrangement embodying herein wherein such blocker means, when not folded and when supported by the flat bottom portions, is capable of substantially covering the pipe trench). Typically, the flat base 62 is round, and either forty-eight inches in diameter, or sixty inches in diameter. Preferably, the debris-catcher 32 is also round (embodying herein wherein such blocker is substantially round), and at least forty-four inches in diameter for a forty-eight inch flat base 62, and at least fifty-six inches in diameter for a sixty inch flat base 62 (this arrangement embodying herein wherein such substantially round blocker has a diameter selected from the group consisting of: diameters of about forty-four inches to about forty-eight inches; diameters of about fifty-four inches to about sixty inches). Upon reading the teachings of this specification, those with ordinary skill in the art, will now appreciate that, under appropriate circumstances, considering issues such as manhole dimensions, economics considerations, etc., other dimensions of the debris-catcher 32, such as, for example, forty-seven inches etc., may suffice. Preferably, the debris-catcher 32 is slightly less than the full diameter of the flat base, as such manhole structures 30 are not usually a perfect diameter and may have a ladder rung 48 that will interfere with opening a folded debris-catcher 32 that is too large a diameter.

Figure 3:
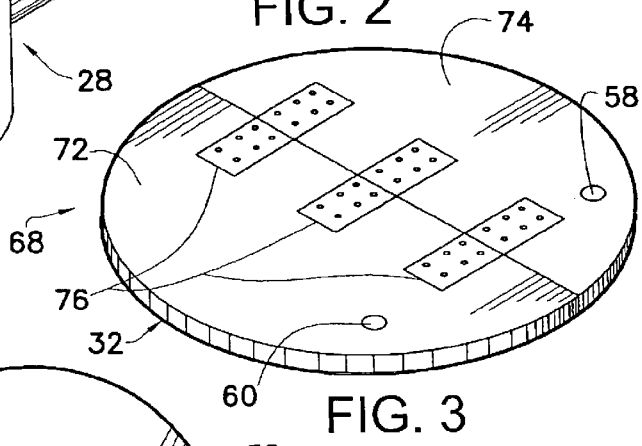
FIG. 3 is a perspective view of a debris-catcher in the open position, according to a preferred embodiment of the present invention.
Figure 4:
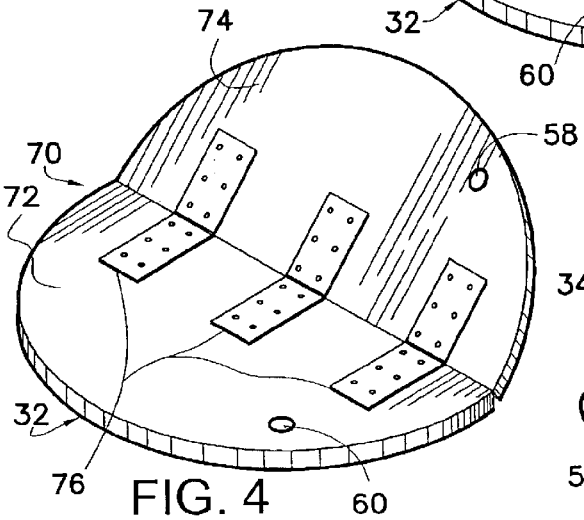
FIG. 4 is a perspective view of a debris-catcher in a partially folded position, according to a preferred embodiment of the present invention.

FIG. 3 is a perspective view of a debris-catcher 32 in the open position 68, according to a preferred embodiment of the present invention. FIG. 4 is a perspective view of a debris-catcher 32 in a partially folded position 70, according to a preferred embodiment of the present invention. Preferably, the debris-catcher 32 comprises two halves 72 and 74 (embodying herein two half-portions). Preferably, each half 72 and 74 is substantially a semi-circle, as shown. Preferably, each half 72 and 74 is connected to the other by hinges 76 (embodying herein at least one hinge connection connecting such two half-portions; and also embodying herein wherein such fold means comprises at least one hinge; and, embodying herein wherein such blocker comprises at least one hinge connection having at least one hinge axis through a center of such blocker). Preferably, hinges 76 comprise three strap hinges, as shown. Preferably, the hinges 76 are type 304 stainless steel (the above arrangement embodying herein wherein such at least one hinge connection comprises three corrosion-resistant strap hinges; and, embodying herein three stainless steel strap hinges). Each hinge is preferably six-knuckle construction with one-half inch ends, three-quarter inch centers being pin spun on both ends. Preferably, the hinges 76 are about four inches wide and sixteen inches long (each half-hinge being eight inches long). Preferably, the hinges 76 are 0.0800–0.125 inches thick. Upon reading the teachings of this specification, those with ordinary skill in the art, will now appreciate that, under appropriate circumstances, considering issues such as strength requirements, weight load, economic considerations, etc., other connection arrangements and material specifications, such as, for example, welded plates, living hinges, etc., may suffice. Furthermore, upon reading the teachings of this specification, those with ordinary skill in the art, will now appreciate that, under appropriate circumstances, considering issues such as storing the debris-catcher, shipping considerations, etc., other construction portions, such as, for example, four piece construction, etc., may suffice.

Figure 13:
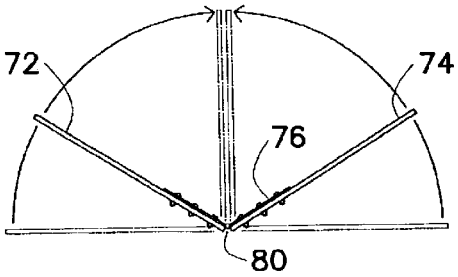
FIG. 13 is a side view of the debris-catcher in a partially folded position, illustrating the folding range of motion, according to a preferred embodiment of the present invention.
Figure 14:
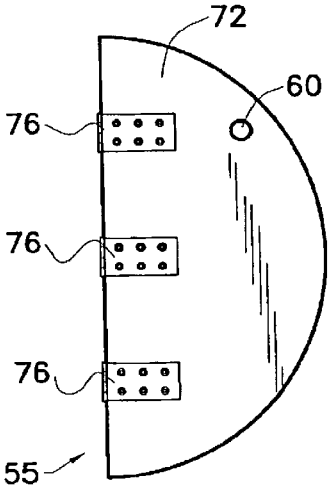
FIG. 14 is a top view of the debris-catcher in the folded position, according to a preferred embodiment of the present invention.

Preferably, the hinges 76 are attached to the debris-catcher 32 such that when the debris-catcher 32 is in the open position 68, the debris-catcher 32 lays in about a flat plane, as shown. Preferably, the hinges 76 are attached to the debris-catcher 32 such that when the debris-catcher 32 is in the folded position 55, the two halves 72 and 74 may be folded in a semi-circle (see FIG. 13 and FIG. 14) configuration allowing entry into the manhole opening 54, as illustrated in FIG. 1, (the above arrangement embodying herein wherein such blocker may be placed in a substantially folded position and in an open substantially-flat position; and, embodying herein fold means for folding such blocker means so as to permit entry of such blocker means, when folded, into the manhole catch basin through the round top; and, also embodying herein at least one hinge structured and arranged to permit folding of such blocker so as to permit entry of such blocker, when folded, through the round top).

Figure 5:
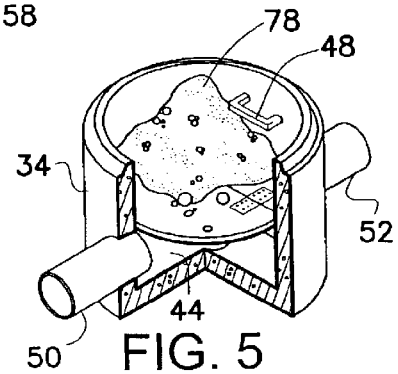
FIG. 5 is a perspective view, partially in section, of the lower section of a typical manhole structure illustrating the debris-catcher blocking debris, according to a preferred embodiment of the present invention.

FIG. 5 is a perspective view, partially in section, of the lower section 34 of a typical manhole structure 30 illustrating the debris-catcher 32 blocking debris 78, according to a preferred embodiment of the present invention. Preferably, the debris-catcher 32, in the open position 68, rests on the flat base 62, as shown, such that the debris-catcher 32 covers the trench 44 (this arrangement embodying herein wherein such substantially round blocker, when in such open substantially-flat position, is structured and arranged to be able to substantially cover the pipe trench portions). Upon reading the teachings of this specification, those with ordinary skill in the art, will now appreciate that, under appropriate circumstances, considering issues such as trench width, etc., other blocking arrangements, such as, for example, utilizing more than one debris-catcher, etc., may suffice. Preferably, as debris falls into the manhole structure 30, it lands on the debris-catcher 32. Preferably, the debris-catcher 32 maintains its integrity and holds the debris 80 until such time as the debris 80 is removed. The present method and composition described herein provides for the debris-catcher 32 to hold well over one hundred pounds of debris 80 (embodying herein wherein such blocker is capable of supporting at least one hundred pounds of debris; and embodying herein wherein such blocker means, when not folded and when supported by the flat bottom portions, is capable of supporting at least about one hundred pounds). Preferably, the debris-catcher 32 will hold the weight of a normal-sized person in addition to the weight of the debris 80 (embodying herein wherein such blocker is capable of supporting at least one normal-sized worker), as a person normally will descend the manhole structure 30 to remove the debris 80. This total weight may be as much as about four hundred pounds using the described preferred embodiments.

Upon reading the teachings of this specification, those with ordinary skill in the art, will now appreciate that, under appropriate circumstances, considering issues such as material considerations, weight load requirements, economic considerations, etc., other weight bearing materials, such as, for example, heavy carbon-fiber, etc., may suffice.

Figure 6:
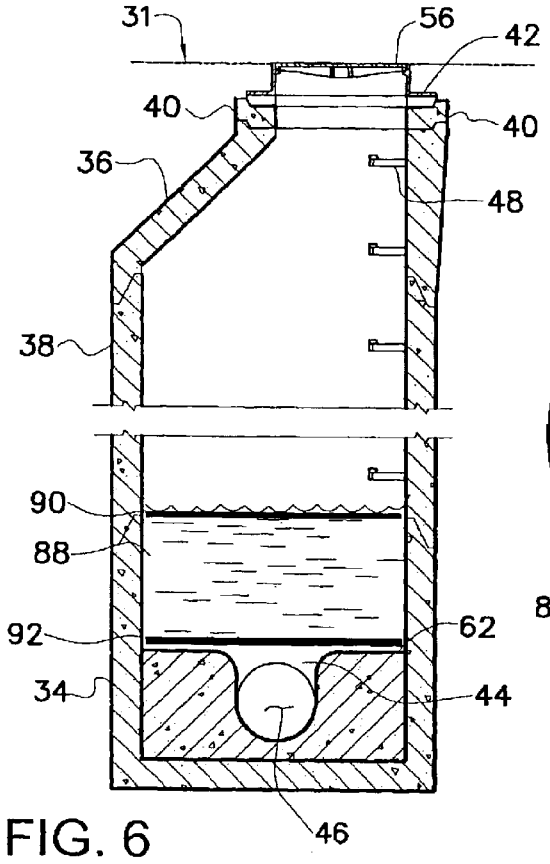
FIG. 6 is a sectional view through the section 6—6 of FIG. 2.
Figure 7:
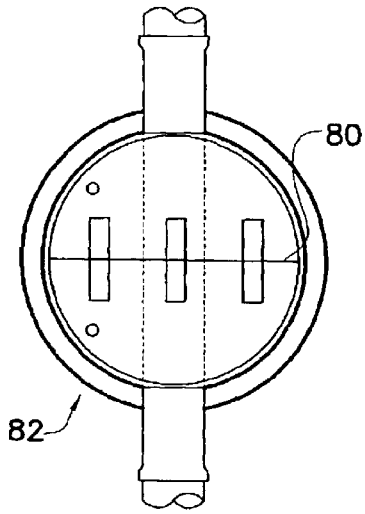
FIG. 7 is a top view, partially in section, illustrating the preferred joint placement of the debris-catcher in a single pipeline manhole installation, according to a preferred embodiment of the present invention.
Figure 8:
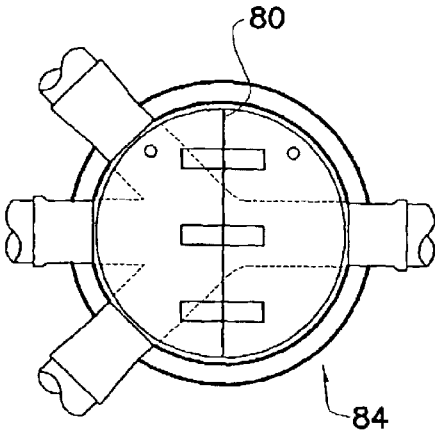
FIG. 8 is a top view, partially in section, illustrating the preferred joint placement of the debris-catcher in a three-way Y-pipeline manhole installation, according to a preferred embodiment of the present invention.
Figure 9:
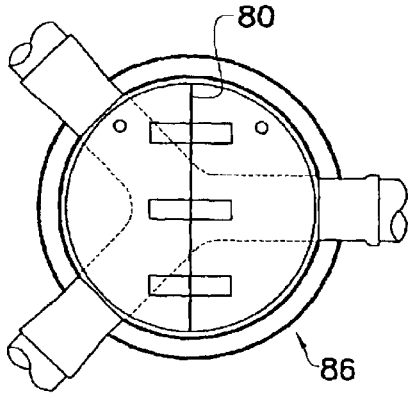
FIG. 9 is a top view, partially in section, illustrating the preferred joint placement of the debris-catcher in a two-way Y-pipeline manhole installation, according to a preferred embodiment of the present invention.

FIG. 6 is a sectional view through section 6—6 of FIG. 2. In one preferred embodiment, the debris-catcher 32 is preferably made from a substantially rigid material (embodying herein a substantially-rigid structural material). The preferred material is High Density Polyethylene, referred to herein as HDPE (embodying herein wherein such structural material comprises High Density Polyethylene). HDPE has excellent chemical resistant properties, weathering capabilities, and stress absorption properties, which make it an excellent choice for use as a debris-catcher 32. Further, HDPE floats. The preferred thickness is one-half inch HDPE sheeting. Upon reading the teachings of this specification, those with ordinary skill in the art, will now appreciate that, under appropriate circumstances, considering issues such as economic consideration, manufacturing, material availability, etc., other materials for use as the debris-catcher, such as, for example, other plastic compositions, etc., may suffice. Preferably, when the debris-catcher 32 is made from HDPE and installed in the manhole structure 30, the debris-catcher 32 allows the uninterrupted function of the flow of effluent or matter through the manhole structure 30. In addition, the debris-catcher 32 will float, as indicated by line 90 in FIG. 6, should an overflow 88 occur (this is what is meant by "floatable", including buoyancy and lifting by overflow pressure) and will resume its position, as indicated by line 92, on the flat base 62 when the overflow 88 has subsided (this arrangement embodying herein wherein such blocker means and blocker is floatable). Preferably, the hinge axis (joint 80) of the debris-catcher 32 is located perpendicular to the trench 44. However, in situations where more than one trench 44 is used, the joint is preferably located such that it is not in-line with the trench 44. Examples of other trench arrangements are illustrated in FIG. 7, FIG. 8 and FIG. 9.

Figure 10:
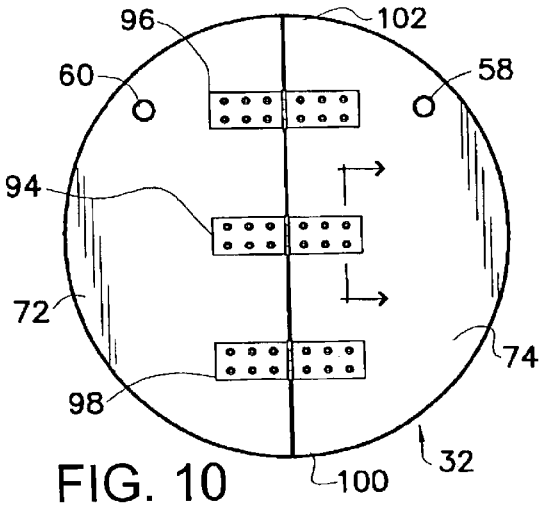
FIG. 10 is a top view of a debris-catcher, according to a preferred embodiment of the present invention.

Reference is now made to the following Figures with continued reference to the above-described Figures. FIG. 7 is a top view, partially in section, illustrating the preferred joint 80 placement of the debris-catcher 32 in a single pipeline manhole 82 installation application, according to a preferred embodiment of the present invention. FIG. 8 is a top view, partially in section, illustrating the preferred joint 80 placement of the debris-catcher 32 in a three-way Y-pipeline manhole 84 installation application, according to a preferred embodiment of the present invention. FIG. 9 is a top view, partially in section, illustrating the preferred joint 80 placement of the debris-catcher 32 in a two-way Y-pipeline 86 manhole installation application, according to a preferred embodiment of the present invention. FIG. 10 is a top view of a debris-catcher 32, according to a preferred embodiment of the present invention.

Figure 11:
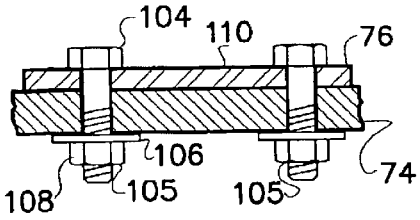
FIG. 11 is a sectional view through the section 11—11 of FIG. 10.
Figure 12:
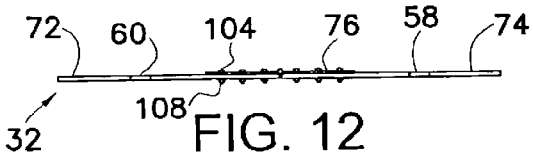
FIG. 12 is a side view of the debris-catcher, according to a preferred embodiment of the present invention.

Preferably, as illustrated in FIG. 10, the hinges 76 comprise three hinges 94, 96 and 98. Preferably, hinge 94 is attached to the debris-catcher 32 such that it is located transverse to the joint 80, approximately midway between the two ends 100 and 102, as shown. Preferably, hinge 96 is located transverse to joint 80, approximately midway between hinge 94 and the end 102, as shown. Preferably, hinge 98 is located transverse to joint 80 approximately midway between hinge 94 and the end 100, as shown. Upon reading the teachings of this specification, those with ordinary skill in the art, will now appreciate that, under appropriate circumstances, considering issues such as weight and strength considerations, economics, etc., other methods of aligning the hinges, such as, for example, offset alignment, etc., may suffice FIG. 11 is a sectional view through section 11—11 of FIG. 10. FIG. 12 is a side view of the debris-catcher 32, according to a preferred embodiment of the present invention. Preferably, as illustrated in FIG. 11 and more specifically shown in FIG. 18, the hinges 76 are attached to each half 72 and 74 using a bolt 104, washer 106, and nut 108 arrangements. Preferably, each hinge 76 is attached using a plurality of corrosion-resistant bolts 104, washers 106, and nuts 108 (embodying herein a plurality of stainless steel bolts, corrosion resistant washers, and stainless steel nuts; and also embodying herein wherein such plurality of stainless steel bolts, corrosion resistant washers and stainless steel nuts connects such three stainless steel strap hinges with such blocker). In the illustrated embodiment of FIG. 18, twelve such bolt 104, washer 106 and nut 108 arrangements are preferably utilized. Preferably, bolt 104 is placed through the top 110 of hinges 76 through pre-drilled holes 112 (see FIG. 18), passing through matching aligned pre-drilled holes 114 in the debris-catcher 32, as shown. Preferably, washer 106 is placed onto bolt 104, followed by nut 108, which is then preferably threaded onto bolt 104, in well-known ways, such that the nut 108 is tight against the washer 106 and debris-catcher 32. In addition, the bolt 104 is preferably about flush with the bottom 105 of the nut 108 when the nut 108 has been fully tightened. Preferably, in the above-described manner, the hinges 76 are firmly attached to the debris-catcher 32. Upon reading the teachings of this specification, those with ordinary skill in the art, will now appreciate that, under appropriate circumstances, considering issues such as economics, size and dimension of the debris-catcher, etc., other methods of hinge 76 attachment, such as, for example, rivets, etc., may suffice.

Preferably, bolts 104 are military standard MS35307 hexagon head, steel, and corrosion resisting bolts. In the preferred embodiment using one-half inch HDPE and 0.0800–0.125 inch thick hinges, a one-inch long bolt 104 is preferred. Preferably, bolt 104 has a diameter of three-eighths of an inch. Under appropriate circumstances, other arrangements may suffice. Preferably, washers 106 are military standard MS15795 flat-metal round washers sized to fit bolts 104. Preferably, nuts 108 are military standard MS51971 steel, hexagon, corrosion-resisting bolts sized to fit bolts 104. Upon reading the teachings of this specification, those with ordinary skill in the art, will now appreciate that, under appropriate circumstances, considering issues such as economic consideration, durability, etc., other types and sizes of bolts 104, such as, for example, airplane bolts, etc., may suffice.

Figure 15:
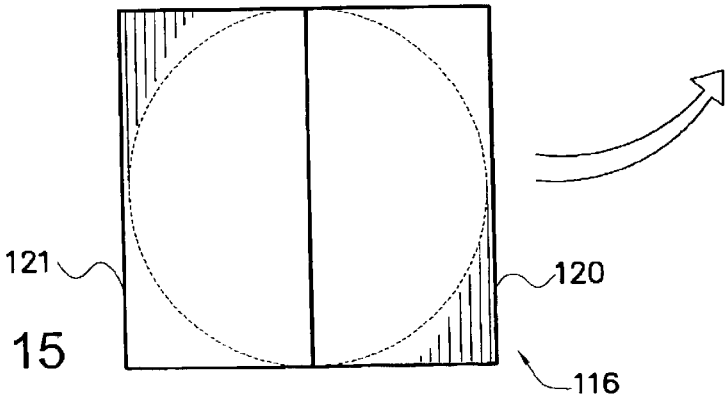
FIG. 15 is a diagrammatic top view of the first step in a method of making a debris-catcher, according to a preferred embodiment of the present invention.
Figure 16:
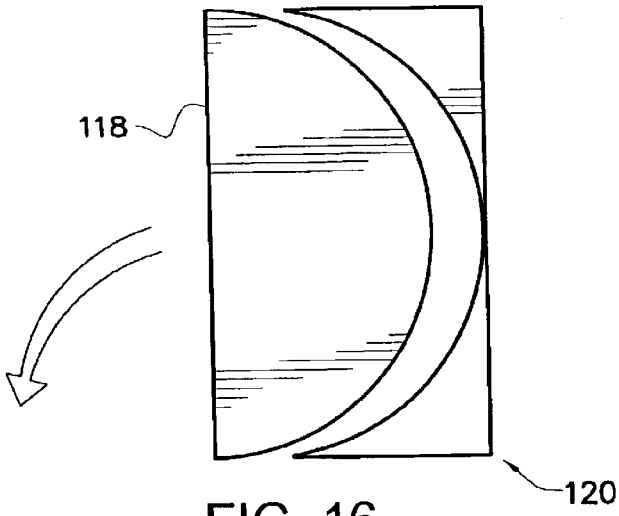
FIG. 16 is a diagrammatic top view of another step in a method of making a debris-catcher, according to a preferred embodiment of the present invention.
Figure 17:
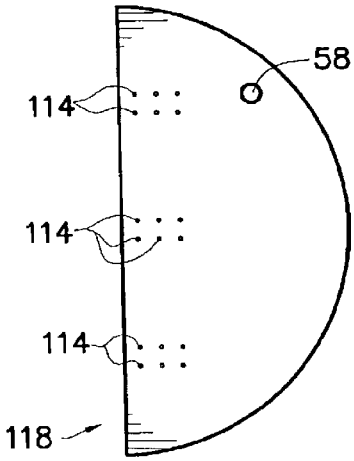
FIG. 17 is a diagrammatic top view of yet another step in a method of making a debris-catcher, according to a preferred embodiment of the present invention.
Figure 18:
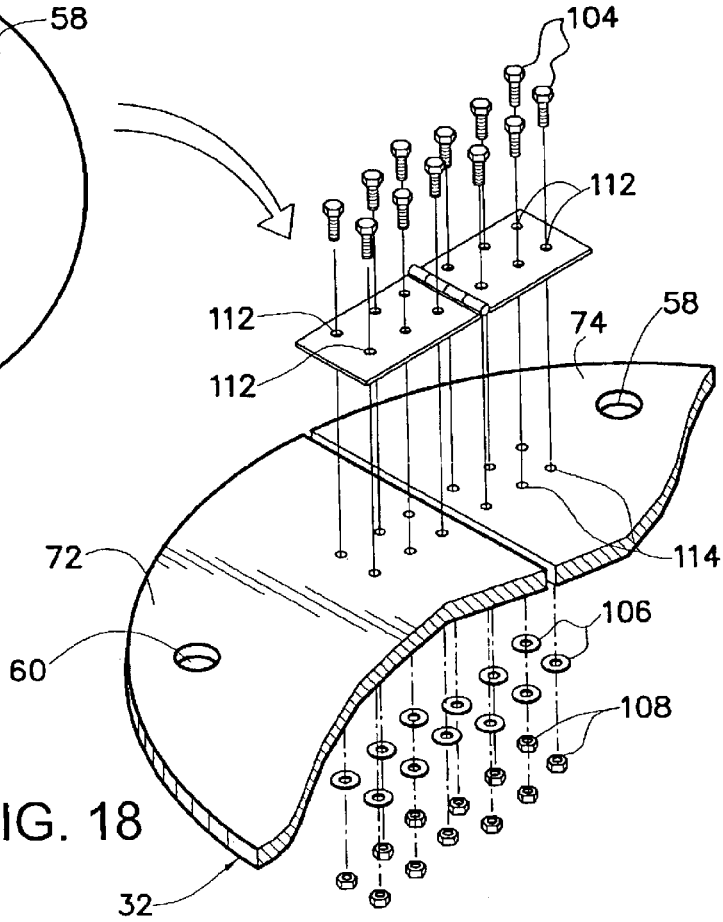
FIG. 18 is a perspective view, partially in section, of a further step in a method of making a debris-catcher, according to a preferred embodiment of the present invention.

FIGS. 15 through 18 illustrate a preferred method of making the debris-catcher 32. FIG. 15 is a diagrammatic top view of the first step in a method of making a debris-catcher 32, according to a preferred embodiment of the present invention. FIG. 16 is a diagrammatic top view of another step in a method of making a debris-catcher 32, according to a preferred embodiment of the present invention. FIG. 17 is a diagrammatic top view of yet another step in a method of making a debris-catcher 32, according to a preferred embodiment of the present invention. FIG. 18 is a perspective view, partially in section, of a further step in a method of making a debris-catcher 32, according to a preferred embodiment of the present invention.

Preferably, the debris-catcher 32 is made from one-half inch thick HDPE sheeting. Such sheeting is typically supplied in forty-eight inch and sixty-inch square sheets (this arrangement embodying herein the step of providing a structural material having an area capable of being cut to a diameter of the required end size). Preferably, as stated above, the debris-catcher 32 is round and at least forty-four inches in diameter for a forty-eight inch flat base 62, and at least fifty-six inches in diameter for a sixty-inch flat base 62. Preferably, a debris-catcher for a forty-eight inch flat base 62 is cut from a forty-eight inch HDPE sheeting. Preferably, a debris-catcher for a sixty-inch flat base 62 is cut from a sixty inch HDPE sheeting.

In the first preferred step of making a debris-catcher 32, the selected HDPE sheeting 116 is cut in halves 120 and 121, as illustrated in FIG. 15 (this arrangement embodying herein the step of cutting such structural material into two equal halves). The sheeting is very heavy, and cutting it in half allows for a more easily workable size. Upon reading the teachings of this specification, those with ordinary skill in the art, will now appreciate that, under appropriate circumstances, considering issues such as manufacturing, economics, durability, etc., other methods of making the debris-catcher, such as, for example, molding, etc., may suffice.

Preferably, a semi-circle 118 having a radius of one-half of the selected final diameter is then cut from the halves 120 and 121, as shown in FIG. 16 (this arrangement embodying herein the step of cutting each such half in a semi-circle shape having a radius half that of such desired end diameter of such debris-catcher so that each such respective half is substantially equal to each other such half). Several methods and tools may be used by those knowledgeable in such art, however, it is preferred to use a Rebel® Roto-zip® tool with a Saber-Cut Zip-bit cutting bit (available from Roto-zip Tool Company).

Preferably, after the semi-circle 118 is cut, the pre-drilled holes 112 and apertures 58 and 60 are drilled, as illustrated in FIG. 17, using a standard drill press. Preferably, the two apertures 58 and 60 will align with each other when respective halves 120 and 121 are aligned, as when they are in a folded position as described-above with reference to FIG. 14 and FIG. 1 (embodying herein wherein each such lifting aperture is structured and arranged to align with each other respective such lifting aperture when each respective such half is aligned). Preferably, the aligned two apertures 58 and 60 are to be used for raising and lowering the debris-catcher 32 (this arrangement embodying herein whereby each respective aligned lifting aperture can be used together to lift such halves when aligned). Preferably, the pre-drilled holes 114 are drilled next, arranged to align with the hinge pre-drilled holes 112 such that the hinges may be installed connecting each respective halves 120 and 121 (this arrangement embodying herein the step of drilling a plurality of hinge-installation apertures in each such half in such manner as to enable insertion of a corrosion-resistant bolt through each respective such hinge-installation aperture). Upon reading the teachings of this specification, those with ordinary skill in the art, will now appreciate that, under appropriate circumstances, considering issues such as manufacturing, economics, etc., other methods of manufacturing, such as, for example, pre-formed molding of apertures, etc., may suffice. Similar procedures of drilling are generally well-known by those knowledgeable in the art.

Preferably, in the final step of making a debris-catcher 32, the hinges 76 are attached using the bolt 104, washer 106, and nut 108 arrangement, and the two halves 120 and 121 are joined such that the debris-catcher may be placed in a substantially folded position 55 or open position 68 (the above arrangement embodying herein the step of attaching at least one hinge to each such half using such corrosion-resistant bolts, at least one washer, and at least one corrosion-resistant nut, along a hinge axis corresponding to a flat edge of each such half so that such halves can be folded together in a folded position for entry through the top and opened to a substantially-flat position to provided a round such debris catcher having such desired diameter of such required end size). Upon reading the teachings of this specification, those with ordinary skill in the art, will now appreciate that, under appropriate circumstances, considering issues such as economics, manufacturing techniques, etc., other methods of design and manufacturing of the debris-catcher may suffice.

A preferred method of using a debris-catcher for impeding debris from entering pipe trench portions of a manhole catch basin will now be described. The manhole catch basin as described herein, will normally have a round top, with a first diameter, flat bottom portions extending over a first area having a second diameter larger than the first diameter, and pipe trench portions below the flat bottom portions. Also, as described herein, the preferred debris catcher comprises a substantially round blocker comprising a substantially-rigid structural material, two half-portions, at least one hinge connection having a hinge axis and connecting the two half-portions. As described, the blocker may be placed in a substantially folded position or in an open substantially-flat position; and each such half-portion comprises an aperture, each such aperture being structured and arranged to align with each other such aperture when such blocker is placed in such substantially folded position.

Preferably, to use this described debris-catcher, the following steps are preferred. First, there is selected a debris-catcher having such desired diameter of such required end size structured and arranged to substantially cover the pipe trench portions (see FIG. 2) below the flat bottom portions when opened to a substantially-flat position. Next, the user preferably folds the debris-catcher in a folded position (see FIG. 1) along a hinge axis corresponding to a flat edge of each such half so that such halves can be folded together in a folded position for entry through the round top of the manhole (see FIG. 1). Next, the user preferably attaches a lifting device (see FIG. 1) through each aligned aperture and lifting and lowering the debris-catcher through the top of the manhole and down through the manhole catch basin to the flat bottom portions. Next, the user preferably un-attaches the lifting device from the debris-catcher. Next, the user preferably unfolds the debris-catcher such that the debris-catcher is opened to a substantially-flat position with the hinges facing upward toward the top of the manhole (see FIG. 2). And next, the user preferably aligns the hinge axis such that most of the hinge axis is supported by the flat bottom portions (see FIGS. 2, 7, 8 and 9). Upon reading the teachings of this specification, those with ordinary skill in the art, will now appreciate that, under appropriate circumstances, considering issues such as desired function, economic considerations, user preferences, etc., other methods of use, such as, for example, protecting irrigation cisterns, etc., may suffice.

Another preferred embodiment of a method of using a debris-catcher for impeding debris from entering pipe trench portions of a manhole catch basin will now be described. The manhole catch basin, as described above, will normally have a round top with a first diameter, flat bottom portions extending over a first area having a second diameter larger than the first diameter, and pipe trench portions below the flat bottom portions wherein the debris catcher comprises a substantially round blocker comprising a substantially-rigid structural material, two half-portions, at least one hinge connection having a hinge axis and connecting the two half-portions. Preferably, the blocker may be placed in a substantially folded position or in an open substantially-flat position. Preferably, each such half-portion comprises at least one flexible tensioner, perpendicular to such hinge axis, to support such at least one substantially round blocker while being grabbed by at least one blocker rigid lifting device. First, a user will select a debris-catcher having a desired diameter of required end size to substantially cover the pipe trench portions below the flat bottom portions when opened to a substantially-flat position. Next the user will grab the at least one flexible tensioner with at least one blocker rigid lifting device and lift and lower the now folded debris-catcher through the top of the manhole and down through such manhole catch basin to the flat bottom portion. Then the user will un-attach the blocker rigid lifting device from the debris-catcher and unfold the debris-catcher so that such debris-catcher is opened with the hinges facing upward toward such top of the manhole. Preferably, the user aligns the hinge axis so that most of the hinge axis is supported by the flat bottom portions. Then, the user places the rigid lifting device against the hinge and presses the debris catcher into a substantially-flat position. (This arrangement embodies herein a method of using a debris-catcher for impeding debris from entering pipe trench portions of a manhole catch basin having a round top with a first diameter, flat bottom portions extending over a first area having a second diameter larger than the first diameter, and pipe trench portions below the flat bottom portions wherein the debris catcher comprises a substantially round blocker comprising a substantially-rigid structural material, two half-portions, at least one hinge connection having a hinge axis and connecting the two half-portions, and wherein the blocker may be placed in a substantially folded position or in an open substantially-flat position, and wherein each such half-portion comprises at least one flexible tensioner, perpendicular to such hinge axis, being structured and arranged to support such at least one substantially round blocker while being grabbed by at least one blocker rigid lifting device, comprising the steps of: selecting a debris-catcher having such desired diameter of such required end size structured and arranged to substantially cover such pipe trench portions below such flat bottom portions when opened to a substantially-flat position; grabbing such at least one flexible tensioner with such at least one blocker rigid lifting device and lifting and lowering such folded debris-catcher through such top of such manhole and down through such manhole catch basin to such flat bottom portions; un-attaching such at least one blocker rigid lifting device from such debris-catcher; unfolding such debris-catcher such that such debris-catcher is opened to with such hinges facing upward toward such top of such manhole; aligning such hinge axis so that most of such hinge axis is supported by such flat bottom portions; and placing such rigid lifting device against at least one hinge and pressing such debris catcher into a substantially-flat position.)

Figure 19:
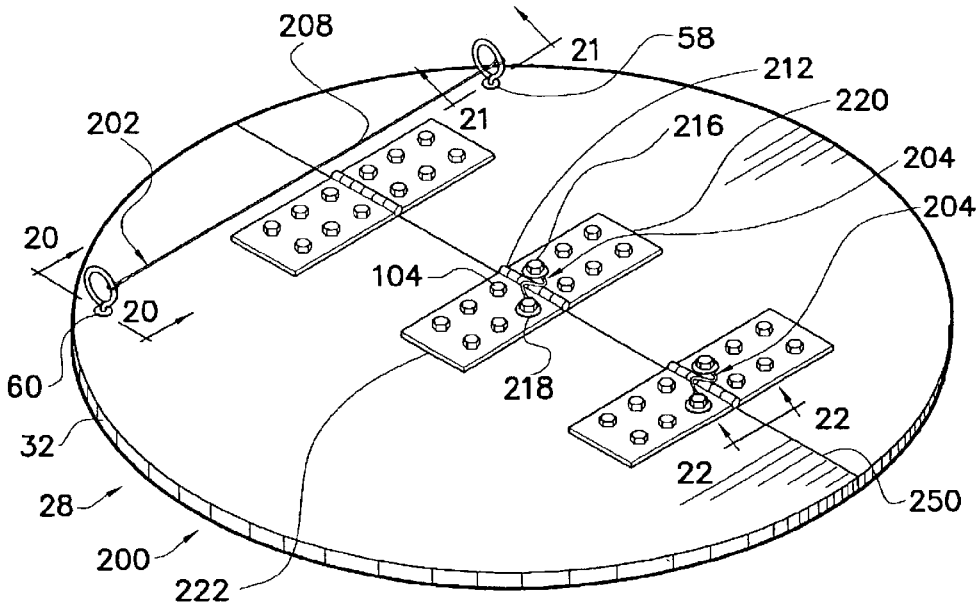
FIG. 19 is a perspective view of a lifting and setting assembly of the debris-catching system according to another preferred embodiment of the present invention.
Figure 20:
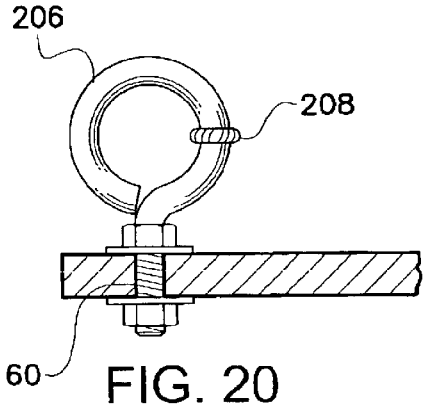
FIG. 20 is a section view through section 20—20 of FIG. 19.
Figure 21:
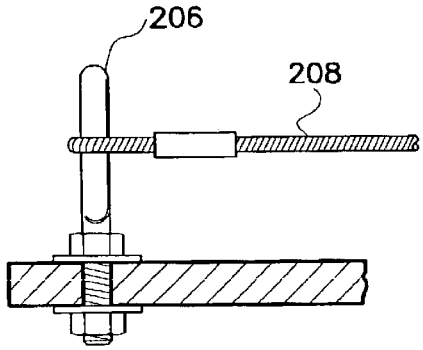
FIG. 21 is a section view through section 21—21 of FIG. 19.

Reference is now made to the following drawings with continued reference to the above drawings. FIG. 19 is a perspective view of a lifting and setting assembly 200 of the debris-catching system 28 according to another preferred embodiment of the present invention. FIG. 20 is a section view through section 20—20 of FIG. 19. FIG. 21 is a section view through section 21—21 of FIG. 19.

In an alternate preferred embodiment, FIG. 19 through FIG. 24 illustrate the above-described debris-catcher 32 with a lifting and setting assembly 200 comprising a lifting device 202 and setting device 204, as shown. Preferably, the lifting device 202 (embodying herein support means for supporting such substantially-rigid blocker means and cooperating with at least one blocker lifting device; and embodying herein at least one support structured and arranged to support such at least one substantially-rigid blocker and cooperate with at least one blocker lifting device) comprises an eye-end 206 bolted through each respective aperture 58 and 60, as shown (embodying herein connector means for connecting such substantially-rigid blocker means with such at least one support; and embodying herein at least one connector structured and arranged to connect such at least one substantially-rigid blocker with such at least one support; and embodying herein wherein such at least one connector further comprises at least two eye-end bolts having such steel cable attached between each respective of such at least two eye-ends). Preferably, a wire 208, preferably steel cable (embodying herein wherein such at least one flexible tensioner comprises a steel cable), is attached between the two eye-ends 206, as shown (embodying herein wherein such at least one support comprises at least one flexible tensioner perpendicular to, adjacent to, and above such hinge axis). Preferably, the wire 208 fully supports the weight of the debris-catcher 200 (embodying herein wherein such at least one flexible tensioner is structured and arranged to support such at least one substantially-rigid blocker while being grabbed by the at least one blocker lifting device). Upon reading the teachings of this specification, those with ordinary skill in the art, will now appreciate that, under appropriate circumstances, considering issues such as desired strength of the wire 208, economic considerations, hardware availability, etc., other methods of attaching wire 208, such as, for example, quick-connect hardware, etc., may suffice.

Figure 22:
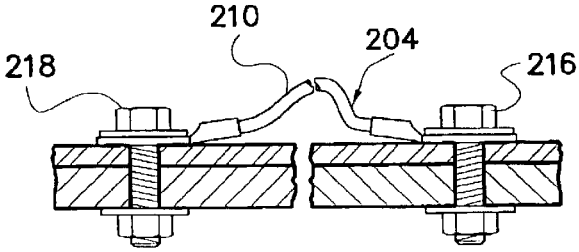
FIG. 22 is a section view through section 22—22 of FIG. 19.

FIG. 22 is a section view through section 22—22 of FIG. 19.

Figure 24:
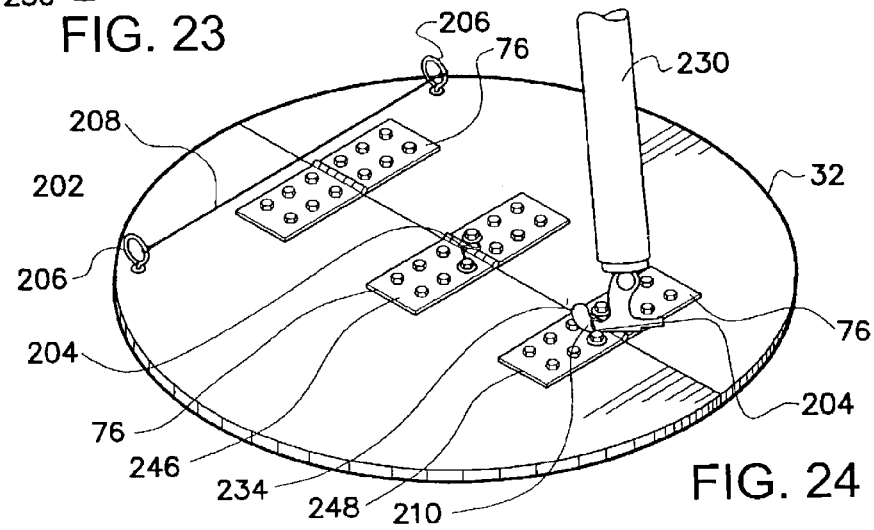
FIG. 24 is another perspective view of the lifting and setting assembly of FIG. 19 in use.

Preferably, the setting device 204 comprises a semi-rigid wire 210 connected between two bolts 104, as shown. Preferably, the semi-rigid wire 210 is just long enough to permit the hook hooked-end 232 beneath the wire 210, as shown in FIG. 24 below. This arrangement embodies herein at least one strap connector, placed across such hinge axis, structured and arranged to be grabbed by such at least one hook. Most preferably, the semi-rigid wire 210 is connected between two adjacent bolts 216 and 218, preferably one bolt 216 on side 220 and one bolt 218 on side 222 of the hinge 212, preferably at an angle of about forty-five degrees from each other respective bolt 216 and 218, as shown. Upon reading the teachings of this specification, those with ordinary skill in the art, will now appreciate that, under appropriate circumstances, considering issues such as desired strength of the wire 210, economic considerations, hardware availability, etc., other methods of attaching wire 210, such as, for example, spot welding the wire 210 to the bolts etc., may suffice.

Figure 23:
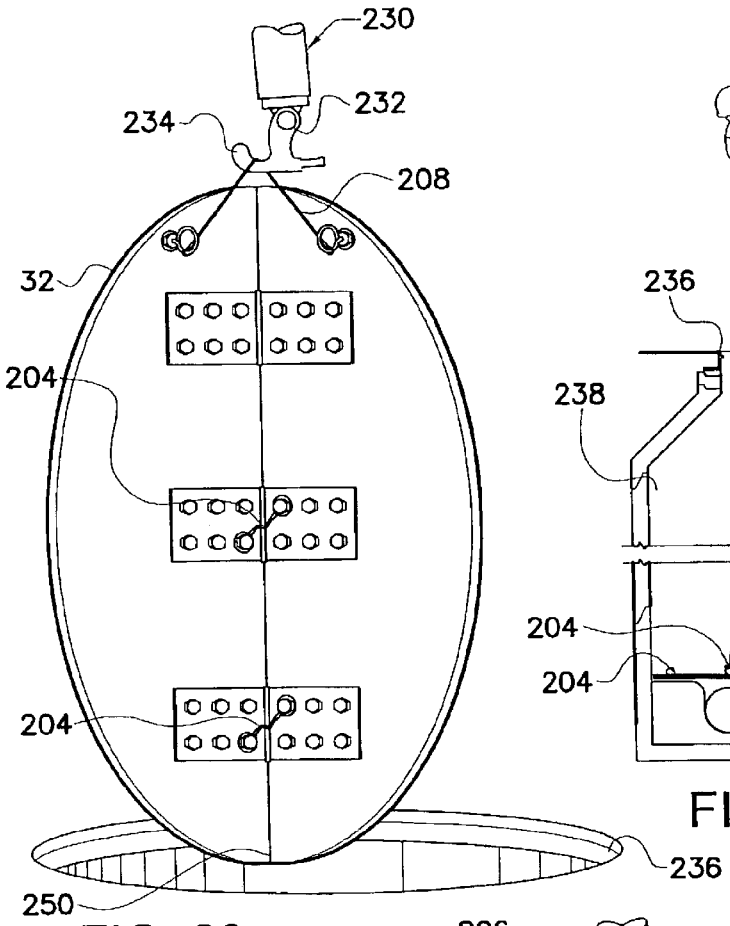
FIG. 23 is a perspective view of the lifting and setting assembly of FIG. 19 in use.

FIG. 23 is a perspective view of the lifting device 202 of FIG. 19 in use. Preferably, in operation, a pole 230 having a hooked end 232 (embodying herein wherein such at least one lifting device comprises: at least one pole, having at least one hook, structured and arranged to removably grab the at least one flexible tensioner; and embodying herein at least one blocker lifting device structured and arranged to grab the at least one flexible tensioner), preferably a telescopic pole, most preferably a Hastings Tel-o-pole® Hot stick (available from www.hfgp.com) is used to lift and lower the debris-catcher 32 into and out of a manhole structure 30. In a preferred embodiment, the hook 234 is placed under the wire 208, as shown. Preferably, pulling up on the wire 208 folds the debris-catcher in a folded position for entry through the round top of the manhole (see FIG. 1). This arrangement embodies herein wherein such at least one substantially-rigid blocker comprises at least one hinge connection having at least one hinge axis through a center of such at least one blocker to permit folding of such at least one substantially-rigid blocker along such at least one hinge axis. Next, the user preferably lowers the debris-catcher 32 through the top 236 of the manhole structure 30 and down through the manhole catch basin 238 to the flat bottom portions 240, as shown. Next, the user preferably un-attaches the lifting device 202 from the debris-catcher 200 by unhooking the hook 234 from the wire 208 allowing the debris-catcher 200 to unfold such that the debris-catcher is opened to a substantially-flat position 242 (embodying herein wherein such at least one connector and such at least one support are structured and arranged to open such at least one hinge upon lowering onto the manhole catch basin by the at least one blocker lifting device to properly place such at least one substantially-rigid blocker) with the hinges facing upward toward the top 236 of the manhole structure 30, as shown (see FIG. 2 and FIG. 25). Next, the user preferably aligns the hinge axis 250 such that most of the hinge axis 250 is supported by the flat bottom portions 240. Preferably, when the debris-catcher 200 is ready to be removed from the manhole structure 30, the lifting device 202 is used to lift the debris-catcher 200. Preferably, the hook 234 is placed under the wire 208 and the debris-catcher 200 is lifted. Preferably, the debris-catcher folds along the hinge axis 250 as the lifting device lifts the debris-catcher 200, as shown. This arrangement embodies herein wherein such at least one connector and such at least one support are structured and arranged to close such at least one hinge upon raising from the manhole catch basin by the at least one blocker lifting device of such at least one substantially-rigid blocker.

Figure 25:
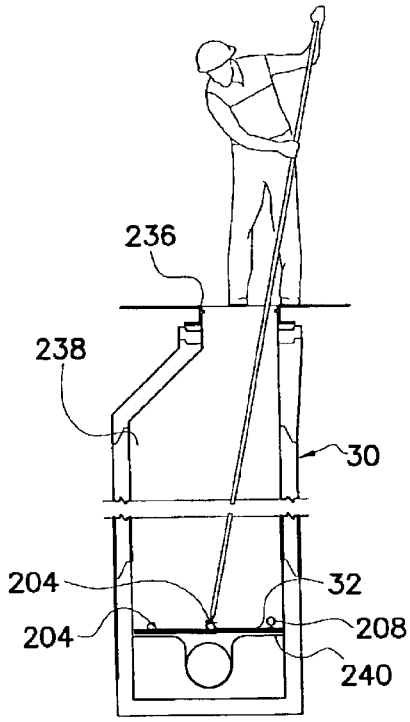
FIG. 25 is a perspective view, partially in section, of the lifting and setting assembly of FIG. 19 in use.

FIG. 24 is another perspective view of the setting device 204 of FIG. 19 in use. FIG. 25 is a perspective view, partially in section, of the lifting device 202 and setting device 204 of FIG. 19 in use according to a preferred embodiment of the present invention. In order to firmly place the debris-catcher 32 in a substantially-flat position 242, it has been determined by applicant that, under appropriate circumstances, the setting device 204 is very useful in positioning the debris-catcher 32 with a pole 230. In operation, the hook 234 is placed under wire 210 and the pole 230 is pushed against the hinge 76 to force the hinge 76 flat, as shown (embodying herein wherein such at least one strap connector, when grabbed by such at least one hook, assists a user to place such substantially-rigid blocker in such open substantially-flat position). Depending on the available space to maneuver the pole 230, the hook 234 is placed on either the center hinge 246 or an end hinge 248, as shown. Upon reading the teachings of this specification, those with ordinary skill in the art, will now appreciate that, under appropriate circumstances, considering issues such as user preference, right or left-handed users, manhole depth, etc., other methods of lowering the debris-catcher, such as, for example, use of a rope and hook, manual placement, etc., may suffice.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A debris-catching system for impeding debris from entering pipe trench portions of a manhole catch basin having a round top with a first diameter, flat bottom portions extending over a first area having a second diameter larger than the first diameter, and pipe trench portions below the flat bottom portions, said system comprising, in combination:

a) substantially-rigid blocker means, supportable by the flat bottom portions and larger than the round top, for blocking debris from entering the pipe trench portions; and b) fold means for folding said blocker means so as to permit entry of said blocker means, when folded, into the manhole catch basin through the round top;

c) at least one support means for supporting said substantially-rigid blocker means and cooperating with at least one blocker lifting device; and d) connector means for connecting said substantially-rigid blocker means with said at least one support means.

2. A debris-catching system for impeding debris from entering pipe trench portions of a manhole catch basin having a round top with a first diameter, flat bottom portions extending over a first area having a second diameter larger than the first diameter, and pipe trench portions below the flat bottom portions, said system comprising, in combination:

a) at least one substantially-rigid blocker, supportable by the flat bottom portions and larger than the round top, structured and arranged, when not folded and when supported by the flat bottom portions, to block debris from entering the pipe trench portions;

b) at least one hinge structured and arranged to permit folding of said at least one substantially-rigid blocker so as to permit entry of said at least one substantially-rigid blocker, when folded, through the round top;

c) at least one support structured and arranged to support said at least one substantially-rigid blocker and cooperate with at least one blocker lifting device; and d) at least one connector structured and arranged to connect said at least one substantially-rigid blocker with said at least one support.

3. The debris-catching system according to claim 2 wherein said at least one substantially-rigid blocker comprises at least one hinge connection having at least one hinge axis through a center of said at least one blocker to permit folding of said at least one substantially-rigid blocker along said at least one hinge axis.

4. The debris-catching system according to claim 3 wherein said at least one connector and said at least one support are structured and arranged to open said at least one hinge upon lowering onto the manhole catch basin by the at least one blocker lifting device to properly place said at least one substantially-rigid blocker.

5. The debris-catching system according to claim 3 wherein said at least one connector and said at least one support are structured and arranged to close said at least one hinge upon raising from the manhole catch basin by the at least one blocker lifting device of said at least one substantially-rigid blocker.

6. The debris-catching system according to claim 4 wherein said at least one connector and said at least one support are structured and arranged to close said at least one hinge upon raising from the manhole catch basin by the at least one blocker lifting device of said at least one substantially-rigid blocker.

7. The debris-catching system according to claim 6 wherein said at least one support comprises at least one flexible tensioner perpendicular to, adjacent to, and above said hinge axis.

8. The debris-catching system according to claim 7 wherein said at least one flexible tensioner comprises a steel cable.

9. The debris-catching system according to claim 7 wherein said at least one flexible tensioner is structured and arranged to support said at least one substantially-rigid blocker while being grabbed by the at least one blocker lifting device.

10. The debris-catching system according to claim 7 further comprising at least one blocker lifting device structured and arranged to grab the at least one flexible tensioner.

11. The debris-catching system according to claim 10 wherein said at least one lifting device comprises: at least one pole, having at least one hook, structured and arranged to removably grab the at least one flexible tensioner.

12. The debris-catching system according to claim 8 wherein said at least one connector further comprises at least two eye-end bolts having said steel cable attached between each respective of said at least two eye-ends.

13. The debris-catching system according to claim 11 wherein said at least one hinge connection comprises:

a) three corrosion-resistant strap hinges; and b) a plurality of corrosion-resistant bolts, corrosion-resistant washers, and corrosion-resistant nuts; and c) at least one strap connector, placed across said hinge axis, structured and arranged to be grabbed by said at least one hook;

d) wherein said plurality of corrosion-resistant bolts, corrosion-resistant washers and corrosion-resistant nuts connects said corrosion-resistant strap hinges to said substantially-rigid blocker; and e) wherein said at least one strap connector, when grabbed by said at least one hook, assists a user to place said substantially-rigid blocker in said open substantially-flat position.

14. A debris-catching system for impeding debris from entering pipe trench portions of a manhole catch basin having a round top with a first diameter, flat bottom portions extending over a first area having a second diameter larger than the first diameter, and pipe trench portions below the flat bottom portions, said system comprising, in combination:

a) a substantially round blocker, wherein said blocker comprises, i) at least one substantially-rigid structural material, ii) two half-portions, and iii) at least one hinge connection connecting said two half-portions;

b) wherein said substantially round blocker may be placed in a substantially folded position and in an open substantially-flat position, c) wherein each said half-portion comprises an eye-end, each said eye-end having at least one wire attached between said eye-ends and being structured and arranged to place said blocker in a substantially folded position when said wire is pulled, d) wherein said wire may be used in lifting and lowering said substantially round blocker when said substantially round blocker is in said substantially folded position; and e) wherein said substantially round blocker, when in said open substantially-flat position, is structured and arranged to be able to substantially cover the pipe trench portions.

15. The debris-catching system according to claim 14 wherein said at least one substantially round blocker has a diameter selected from the group consisting of:

a) diameters of about forty-four inches to about forty-eight inches and;

b) diameters of about fifty-four inches to about sixty inches.

16. The debris-catching system according to claim 14 wherein said at least one substantially-rigid structural material comprises High Density Polyethylene (HDPE).

17. A method of using a debris-catcher for impeding debris from entering pipe trench portions of a manhole catch basin having a round top with a first diameter, flat bottom portions extending over a first area having a second diameter larger than the first diameter, and pipe trench portions below the flat bottom portions wherein the debris catcher comprises a substantially round blocker comprising a substantially-rigid structural material, two half-portions, at least one hinge connection having a hinge axis and connecting the two half-portions, and wherein the blocker may be placed in a substantially folded position or in an open substantially-flat position, and wherein each such half-portion comprises at least one flexible tensioner, perpendicular to said hinge axis, being structured and arranged to support said at least one substantially round blocker while being grabbed by at least one blocker rigid lifting device, comprising the steps of:

a) selecting a debris-catcher having such desired diameter of such required end size structured and arranged to substantially cover such pipe trench portions below such flat bottom portions when opened to a substantially-flat position;

b) grabbing such at least one flexible tensioner with such at least one blocker rigid lifting device and lifting and lowering such folded debris-catcher through such top of such manhole and down through such manhole catch basin to such flat bottom portions;

c) un-attaching such at least one blocker rigid lifting device from such debris-catcher;

d) unfolding such debris-catcher such that such debris-catcher is opened with such hinges facing upward toward such top of such manhole;

e) aligning such hinge axis so that most of such hinge axis is supported by such flat bottom portions; and f) placing such rigid lifting device against at least one hinge and pressing such debris catcher into a substantially-flat position.

* * * * *